US008054191B2

(12) United States Patent
Ciupka

(10) Patent No.: US 8,054,191 B2
(45) Date of Patent: Nov. 8, 2011

(54) OPTICAL SIGNALING DEVICE FOR ELECTRICAL MONITORING DEVICES

(75) Inventor: Matthias Ciupka, Düsseldorf (DE)

(73) Assignee: Dipl.-Ing. H. Horstmann GmbH (DE)

( * ) Notice: Subject to any disclaimer, the term of this patent is extended or adjusted under 35 U.S.C. 154(b) by 571 days.

(21) Appl. No.: 12/197,987

(22) Filed: Aug. 25, 2008

(65) Prior Publication Data

US 2009/0067181 A1 Mar. 12, 2009

(30) Foreign Application Priority Data

Sep. 6, 2007 (DE) ..... 20 2007 012 474 U

(51) Int. Cl.
*G08B 21/00* (2006.01)

(52) U.S. Cl. ..... 340/650; 340/691.1; 340/693.5; 362/362

(58) Field of Classification Search ..... 340/649–654, 340/691.1, 693.5, 815.73; 362/362–375; 361/600

See application file for complete search history.

(56) References Cited

U.S. PATENT DOCUMENTS

2003/0057430 A1* 3/2003 Rinaldi et al. ..... 257/99
2009/0284393 A1* 11/2009 Ochiai ..... 340/907

* cited by examiner

*Primary Examiner* — Jeffery Hofsass
(74) *Attorney, Agent, or Firm* — Davis M. Chin, Jr.; Davis Chin

(57) ABSTRACT

A signaling device for electrical monitoring devices, in particular for short circuit and/or ground fault indicators, and for optical, visually perceptible signaling with at least one luminous element is provided. The signaling device has a housing having a housing wall and a region formed in the housing wall so as to cover the luminous element. A printed circuit board is disposed in the housing. The luminous element is arranged within the housing and directly on the printed circuit board. The housing wall is formed such that it is at least light-transmissive in the region.

12 Claims, 1 Drawing Sheet

OPTICAL SIGNALING DEVICE FOR ELECTRICAL MONITORING DEVICES

BACKGROUND OF THE INVENTION

1. Field of the Invention

The present invention relates, in accordance with the preamble of claim 1, to a signaling device for electrical monitoring devices, in particular for short circuit and/or ground fault indicators in medium voltage installations, for optical, visually perceptible signaling with at least one luminous element.

2. Description of the Prior Art

In a known short circuit indicator, a luminous element in the form of a light emitting diode (LED) is provided as a signaling device, which diode is to be soldered manually onto a printed circuit board by means of connecting wires. In this case, the LED protrudes from the printed circuit board and projects outward in regions with its body through an opening in a housing wall, such that it is visible from outside and its emitted light is visually perceptible. In this case, the LED body has to be sealed by means of a seal (O-ring), in the housing opening in order that a potting compound with which the housing is potted does not escape toward the outside. This known type of signaling device therefore leads to a very high outlay during production and mounting by virtue of the LED having to be manually soldered and sealed in the course of mounting by means of the additional seal in the housing opening.

SUMMARY OF THE INVENTION

The present invention is based on the object of providing a signaling device of the type mentioned which enables simpler, faster and therefore altogether more cost-effective production and mounting in conjunction with improved use properties.

According to the invention, this is achieved by means of the features of independent claim 1. The dependent claims relate to advantageous configuration features of the invention.

Accordingly, according to the invention the luminous element is arranged completely within a closed housing and, in particular, as a so-called SMD-LED directly on a printed circuit board, a housing wall being formed such that it is light-transmissive at least in a region covering the luminous element. The printed circuit board can thereby advantageously be populated with the luminous element—embodied using so-called SMD technology (SMD=Surface Mountable Device)—together with other components in an automated soldering operation, which is simpler, faster and more economic in comparison with a manual soldering operation. In addition, a sealing of the luminous element in the region of a housing opening is obviated. The light emerging from the luminous element nevertheless passes toward the outside through the light-transmissive region of the housing wall in a readily discernible manner. In this case it is particularly advantageous to form the light-transmissive region as an optical lens element, in which case the emission characteristic can be influenced and optimized for the respective use by way of the form and arrangement of the lens element.

BRIEF DESCRIPTION OF THE DRAWINGS

The invention will be explained in more detail on the basis of some preferred exemplary embodiments illustrated in the drawing, in which.

DESCRIPTION OF THE PREFERRED EMBODIMENTS

Figure 1:
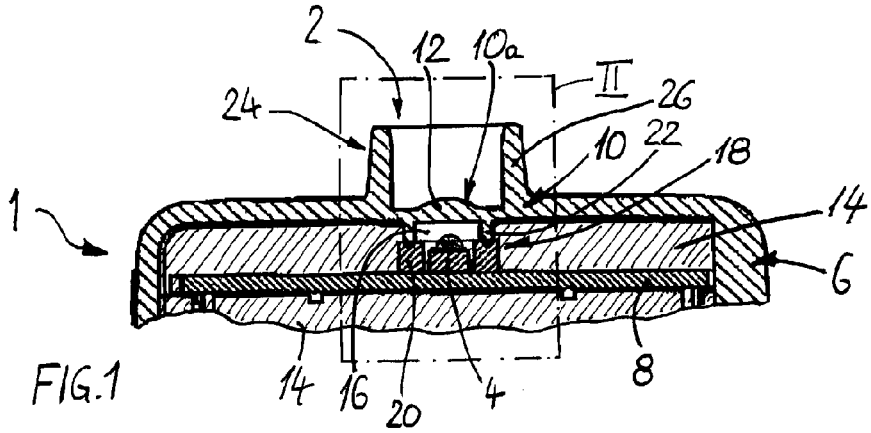
FIG. 1 shows a partial region of an electrical device comprising a first embodiment of a signaling device according to the invention in a section along an optical light emission axis.

In the various figures of the drawing, identical parts are always provided with the same reference symbols.

Of an electrical monitoring device 1, only a partial region in which a signaling device 2 according to the invention is arranged is illustrated in the drawing. The monitoring device 1 can be formed as a short circuit and/or ground fault indicator in particular for medium voltage installations (voltage range from approximately 1 kV to approximately 60 kV). The signaling device 2 has (at least) one luminous element 4 for optical, visually perceptible signaling.

According to the invention, the luminous element 4 is arranged within a housing 6 directly on a printed circuit board 8. In this case, a housing wall 10 is formed such that it is light-transmissive at least in a region 10*a* covering the luminous element 4. In an advantageous configuration, the region 10*a* of the housing wall 10 that covers the luminous element 4 is configured as an optical lens element 12. In this case, the form and arrangement of the lens element 12 is as desired, in principle, in order thus to influence the emission characteristic and optimize it for the respective use.

In the first embodiment in accordance with FIG. 1, the housing wall 10 is composed completely of a light-transmissive or even transparent material, in particular composed of a transparent plastic such as, for example, PMMA (polymethyl methacrylate, also called acrylic glass).

Figure 2:
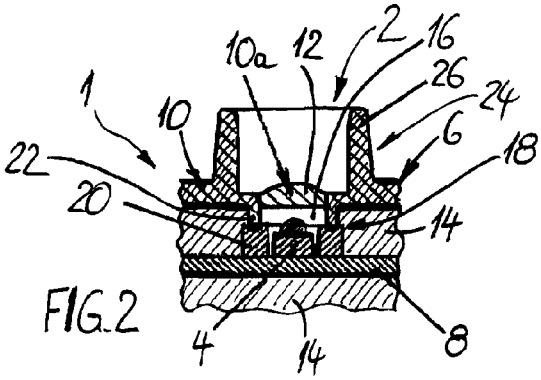
FIG. 2 shows an excerpt from the region II in FIG. 1 in an embodiment variant.

In the variant illustrated in FIG. 2, the housing wall 10 is composed of a light-transmissive material only in its region 10*a* covering the luminous element 4 and is composed of a different, substantially light-opaque material in the remaining region. In this case, it is expedient if the housing wall 10 is formed as a two-component molding composed of a first, transparent plastic in the region 10*a* covering the luminous element 4 and composed of a second, nontransparent plastic in the remaining region.

Figure 3:
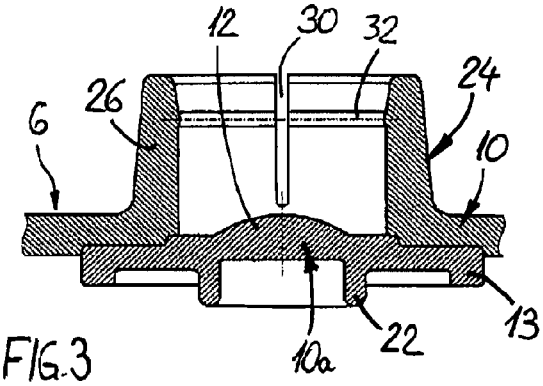
FIG. 3 shows an enlarged partial excerpt from FIG. 2 in a further variant.

In the variant illustrated in FIG. 3, a light-transmissive, e.g. circular-disk-type part 13 is cohesively fixed, in particular injection-molded, on the inner side of the light-opaque housing wall 10, the part 13 covering a light opening in the housing wall 10 and closing it off hermetically, but in light-transmissive fashion.

As is furthermore apparent from FIGS. 1 and 2, the housing 6 is potted on the inside with an, in particular light-opaque, potting compound 14. As usual, such a potting compound 14 is introduced by filling in a liquid or flowable state, such that it completely fills the interior of the housing. The potting compound 14 then cures automatically. According to the invention, the luminous element 4 is in this case arranged within the housing 6 in a chamber 16 that is partitioned from the potting compound 14 and thereby not potted. Said chamber 16 is arranged between the printed circuit board 8 carrying the luminous element 4 and the opposite housing wall 10 and is enclosed circumferentially toward the side by a sealing arrangement 18 enclosing the luminous element 4. In the preferred embodiments illustrated, the sealing arrangement 18 comprises a sealing ring 20 enclosing the luminous element 4, said sealing ring being arranged such that it bears in a sealing manner between the printed circuit board 8 and the housing wall 10 or the region 10*a* thereof. The sealing ring 20 is preferably composed of a soft, elastic material such as microcellular rubber or the like. In this case, it is advantageous if the housing wall 10 or the region 10*a* thereof has on the inner side a ring-web-type sealing attachment 22 bearing on the sealing ring 20 in sealing fashion, the sealing ring 20 on the other side lying directly on the printed circuit board 8. This preferred configuration of the sealing arrangement 18 enables very simple mounting. In the embodiment in accordance with FIG. 3, the sealing attachment 22 is an integral part of the transparent part 13.

In a further preferred configuration of the invention, a projecting shadow zone 24 is adjacent to the light-transmissive region 10*a* on the outer side of the housing. As a result, the light-transmissive region 10*a* or the lens element 12 is shaded on the outer side against light from outside in order that the signal light emerging from the luminous element 4 is made better discernible.

In the embodiments in accordance with FIGS. 1, 2 and 3 the light-transmissive region 10*a* lies approximately in a plane with the rest of the housing wall 10, the shadow zone 24 projecting outward as a ring web 26 from the housing wall 10.

Figure 4:
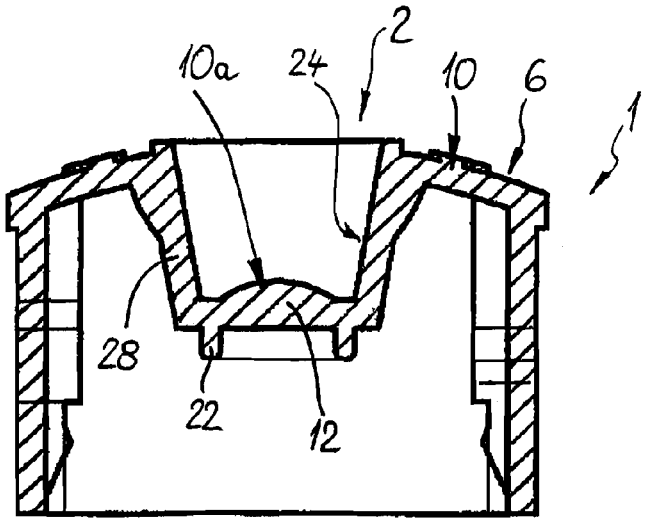
FIG. 4 shows a housing part in a section analogously to FIGS. 1 and 2 for an alternative embodiment of the signaling device according to the invention.

In the alternative illustrated in FIG. 4, the light-transmissive region 10*a* is offset inward relative to the rest of the housing wall 10 by way of the shadow zone 24. The shadow zone 24 is thus formed by a ring-web-type wall section 28 that connects the housing wall 10 to the light-transmissive region 10*a*.

In both alternatives, the light-transmissive region 10*a* or the lens element 12 practically forms a bottom region of the shadow zone 24 projecting in ring-wall-type fashion in a manner proceeding therefrom.

An end of an optical waveguide (not illustrated) can optionally be inserted into the interior of the shadow zone 24 in order as necessary to guide the light emerging from the luminous element 4 away from the region 10*a* or the lens element 12 to some other location. In accordance with FIG. 3, for this purpose the wall of the ring web 26 can have slots 30 and interior latching means 32 in order to form an elastic latching connection for the optical waveguide.

A light emitting diode (LED) or organic light emitting diode (OLED) embodied using SMD technology is preferably used as the luminous element 4. This enables the printed circuit board 8 to be populated automatically in a soldering bath.

Finally, it should be noted that the invention also relates to a practically arbitrary electrical monitoring device 1 in its entirety comprising a signaling device 2 according to the invention. The monitoring device 1 is preferably formed as a short circuit and/or ground fault indicator for example for electrical overhead lines or cables in particular in the medium voltage range.

The invention is not restricted to the exemplary embodiments illustrated and described, but rather also encompasses all embodiments that are equivalent within the meaning of the invention. Furthermore, the invention is hitherto also not yet restricted to the combination of features defined in the respective independent claim, but rather can also be defined by any desired other combination of specific features of all the individual features disclosed overall. This means that in principle practically any individual feature of the respective independent claim can be omitted or replaced by at least one individual feature disclosed elsewhere in the application. In this respect, the claims should merely be understood as a first attempt for formulating an invention.

The invention claimed is:

1. Signaling device (2) for electrical monitoring devices (1) for one of short circuit and ground fault indicators, and for optical, visually perceptible signaling with at least one luminous element (4), comprising:

a housing (6) having a housing wall (10) and a centrally-disposed region (10*a*) formed in said housing wall (10) so as to cover said at least one luminous element (4);

said housing wall including a projecting shadow zone (24) being formed adjacent to said centrally-disposed region (10*a*);

a printed circuit board (8) being disposed in said housing (6);

said luminous element (4) being arranged within said housing (6) and directly on said printed circuit board (8); and said housing wall (10) being formed of a light-transmissive material only in said centrally-disposed region (10*a*) covering said at least one luminous element (4) and being formed of a light-opaque material in the remaining region thereof so as to define a two-component molding.

2. A signaling device as claimed in claim 1, wherein said region (10*a*) of the housing wall (10) that covers the luminous element (4) is formed as an optical lens element (12).

3. A signaling device as claimed in claim 1, wherein said housing (6) is potted on the inside with a light-opaque, potting compound (14), the luminous element (4) being arranged in a chamber (16) partitioned from the potting compound (14).

4. A signaling device as claimed in claim 3, wherein said chamber (16) is formed between the printed circuit board (8) carrying the luminous element (4) and the housing wall (10) and a sealing arrangement (18) enclosing the luminous element (4).

5. A signaling device as claimed in claim 4, wherein said sealing arrangement (18) comprises a sealing ring (20) enclosing the luminous element (4), said sealing ring being composed of a soft, elastic material, and being arranged such that it bears in sealing fashion between the printed circuit board (8) and the housing wall (10).

6. A signaling device as claimed in claim 5, wherein said housing wall (10) has on its inner side a ring-web-type sealing attachment (22) bearing on the sealing ring (20) in sealing fashion.

7. A signaling device as claimed in claim 1, wherein said light-transmissive region (10*a*) of the housing wall (10) that covers the luminous element (4) is formed, on the outer side of the housing, as the bottom region of a shadow zone (24) projecting in ring-web-like fashion.

8. A signaling device as claimed in claim 7, wherein said light-transmissive region (10*a*) lies approximately in a plane with the rest of the housing wall (10), the shadow zone (24) projecting outward as a ring web (26) from the housing wall (10).

9. A signaling device as claimed in claim 7, wherein said light-transmissive region (10*a*) is offset inward relative to the rest of the housing wall (10) by way of the shadow zone (24) forming a ring-web-type wall section (28).

10. In a signaling device as claimed in claim 1, wherein said luminous element (4) is a light-emitting diode (LED) or an organic light emitting diode (OLED) or SMD-LED or SMD-OLED.

11. In an electrical monitoring device including a signaling device, said signaling device comprising:

a housing having a housing wall and a centrally-disposed region formed in said housing wall so as to cover at least one luminous element;

said housing wall including a projecting shadow zone being formed adjacent to said centrally-disposed region;

a printed circuit board being disposed in said housing;

said luminous element being arranged within said housing and directly on said printed circuit board; and said housing wall being formed of a light-transmissive material only in said centrally-disposed region covering said at least one luminous element and being formed of a light-opaque material in the remaining region thereof so as to define a two-component molding.

12. In an electrical monitoring device as claimed in claim 11, wherein said signaling device has a configuration as one of a short circuit and ground fault indicator.

* * * * *